US007374280B2

(12) United States Patent
Kusunoki

(10) Patent No.: US 7,374,280 B2
(45) Date of Patent: May 20, 2008

(54) IMAGE FORMING APPARATUS AND METHOD

(75) Inventor: Naoki Kusunoki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 247 days.

(21) Appl. No.: 11/370,907

(22) Filed: Mar. 9, 2006

(65) Prior Publication Data

US 2006/0203024 A1 Sep. 14, 2006

(30) Foreign Application Priority Data

Mar. 10, 2005 (JP) ..... 2005-067823

(51) Int. Cl.
*B41J 2/01* (2006.01)

(52) U.S. Cl. ..... 347/102; 347/6; 347/93; 347/95

(58) Field of Classification Search ..... 347/102
See application file for complete search history.

(56) References Cited

U.S. PATENT DOCUMENTS

2003/0222961 A1* 12/2003 Nakajima ..... 347/102
2005/0185040 A1* 8/2005 Nagashima ..... 347/102
2006/0033794 A1* 2/2006 Yamanobe ..... 347/102

FOREIGN PATENT DOCUMENTS

JP 2004-42548 A 2/2004

* cited by examiner

*Primary Examiner*—Matthew Luu
*Assistant Examiner*—Brian J. Goldberg
(74) *Attorney, Agent, or Firm*—Birch, Stewart, Kolasch & Birch, LLP

(57) ABSTRACT

The image forming apparatus comprises: an ink ejection device which ejects droplets of a radiation-curable ink onto a recording medium; a conveyance device which causes the ink ejection device and the recording medium to move relatively to each other in a relative movement direction by conveying at least one of the ink ejection device and the recording medium; a radiation irradiation device which irradiates radiation to the droplets deposited on the recording medium by the ink ejection device; a dot formation conditions determination device which determines a dot size of dots and a pitch between adjacent dots to be formed by the ejected droplets, according to print data; and a droplet ejection timing control device which sets an ejection interval between the droplets according to information relating to the dot size and the dot pitch determined by the dot formation conditions determination device, and controls an ejection timing of a subsequent droplet ejected subsequently in an overlapping fashion, in such a manner that the subsequent droplet is ejected to form a dot overlapping with a dot formed by a droplet deposited previously on the recording medium, after a surface of the previously deposited droplet is preliminarily cured to a threshold cured film thickness by the radiation.

6 Claims, 10 Drawing Sheets

FIG.3

| TYPE OF INK | TYPE OF RECORDING MEDIUM | UV IRRADIATION ENERGY | DOT DIAMETER (FIRST DOT) | DOT DIAMETER (SECOND DOT) | PITCH BETWEEN DOTS | |
|---|---|---|---|---|---|---|
| INK A1 | RECORDING MEDIUM B1 | ENERGY E1 | D1 | D1 | PT1 | ••• |
| INK A1 | RECORDING MEDIUM B1 | ENERGY E1 | D2 | D1 | PT1 | ••• |
| INK A2 | RECORDING MEDIUM B2 | ENERGY E2 | D1 | D2 | PT1 | ••• |
| ••• | ••• | ••• | ••• | ••• | ••• | ••• |

IMAGE FORMING APPARATUS AND METHOD

BACKGROUND OF THE INVENTION

1. Field of the Invention

The present invention relates to an image forming apparatus and method, and more particularly, to an image forming apparatus and method for forming images on a recording medium by using a radiation-curable ink which is cured by irradiation of radiation such as ultraviolet light or the like.

2. Description of the Related Art

Technology using ultraviolet-curable ink (so-called UV ink) in an inkjet type image forming apparatus is known. Japanese Patent Application Publication No. 2004-42548 discloses technology for preventing the occurrence of mottling and bleeding, in cases where dots are recorded by depositing droplets of ultraviolet-curable ink from different nozzles, at prescribed staggered time intervals, by irradiating ultraviolet light in conjunction with the deposition timing of the respective droplets, thereby pre-curing mutually adjacent droplets to a degree which prevents them from mixing together, and then subsequently irradiating ultraviolet light again to perform main curing.

However, in ultraviolet-curable inks, it is rare for the viscosity to pass through a semi-solidified state and for the ink to then solidify, due to irradiation of radiation, and in most cases, the ink changes directly from a liquid state to a solid state. In other words, when ultraviolet light is irradiated onto ultraviolet-curable ink droplet after the ink droplet has been deposited, rather than the viscosity of the ink droplet increasing and the ink droplet thereby solidifying in a continuous fashion as the ultraviolet light is irradiated, the solidification takes place in a step fashion (liquid phase to solid phase) from the outer surface of the approximately hemispherical ink droplet toward the inside.

In order to deposit ink droplets at high speed while preventing landing interference therebetween, it is necessary to deposit one droplet so as to overlap with another droplet at a timing at which landing interference will not occur, during the curing process which progresses from the surface of the ink droplet to the inner side thereof. However, this timing varies with different conditions. In Japanese Patent Application Publication No. 2004-42548, there is no disclosure regarding optimal droplet deposition timing which takes account of the aforementioned point, and it is not possible to achieve both high-speed printing and high-quality printing.

SUMMARY OF THE INVENTION

The present invention has been contrived in view of the foregoing circumstances, an object thereof being to provide an image forming apparatus and method whereby optimal droplet ejection interval control which is suitable for both high-speed printing and high-quality printing can be achieved, by determining various conditions under which landing interference will not occur, when radiation-curable ink droplets are ejected in a mutually overlapping fashion.

In order to attain the aforementioned object, the present invention is directed to an image forming apparatus, comprising: an ink ejection device which ejects droplets of a radiation-curable ink onto a recording medium; a conveyance device which causes the ink ejection device and the recording medium to move relatively to each other in a relative movement direction by conveying at least one of the ink ejection device and the recording medium; a radiation irradiation device which irradiates radiation to the droplets deposited on the recording medium by the ink ejection device; a dot formation conditions determination device which determines a dot size of dots and a pitch between adjacent dots to be formed by the ejected droplets, according to print data; and a droplet ejection timing control device which sets an ejection interval between the droplets according to information relating to the dot size and the dot pitch determined by the dot formation conditions determination device, and controls an ejection timing of a subsequent droplet ejected subsequently in an overlapping fashion, in such a manner that the subsequent droplet is ejected to form a dot overlapping with a dot formed by a droplet deposited previously on the recording medium, after a surface of the previously deposited droplet is preliminarily cured to a threshold cured film thickness by the radiation.

According to the present invention, when radiation is irradiated onto a droplet that has been deposited on a recording medium, the curing reaction progresses from the liquid surface toward the inside, and the cured film thickness at the surface of the droplet increases gradually with the irradiation time (irradiated energy). In this case, the viscosity in the cured film thickness changes almost uniformly in a step fashion, from the viscosity of the initial liquid state until finally reaching a viscosity where the whole of the droplet has cured completely.

When the droplet reaches a threshold cured film thickness, then it will not combine with another droplet and landing interference will not occur, even if a droplet is ejected to form a subsequent droplet which overlaps with the droplet in question. Therefore, by ejecting a droplet to form a subsequent overlapping droplet while ensuring a droplet ejection interval corresponding to the time period required to achieve the threshold cured film thickness, it is possible to prevent landing interference. In this case, an optimal droplet ejection interval is found by using information relating to at least the size and the pitch between adjacent dots to be formed by ejected droplets. Accordingly, it is possible to set the minimum droplet ejection interval that prevents landing interference, and therefore, high-speed printing and high-quality printing become possible.

Here, "radiation" includes electromagnetic waves, such as visible light, ultraviolet light, or X rays, and electron beams, and the like. Typical examples of a radiation-curable ink are: an ultraviolet-curable ink (UV ink), and an electron beam curable ink (EB ink).

A compositional embodiment of a recording head (ink ejection device) in the image forming apparatus according to the present invention is a full line type head having a row of liquid droplet ejection elements in which a plurality of liquid droplet ejection elements (recording elements which eject ink droplets in order to form dots) are arranged through a length corresponding to the full width of the recording medium. In this case, a mode may be adopted in which a plurality of relatively short recording head modules having liquid droplet ejection element rows which do not reach a length corresponding to the full width of the recording medium are combined and joined together, thereby forming liquid droplet ejection element rows of a length that correspond to the full width of the recording medium.

A full line type head is usually disposed in a direction that is perpendicular to the relative feed direction (relative conveyance direction) of the recording medium, but a mode may also be adopted in which the ejection head is disposed following an oblique direction that forms a prescribed angle with respect to the direction perpendicular to the conveyance direction.

"Recording medium" indicates a medium on which an image is recorded by means of the action of the recording head (this medium may also be called an image forming medium, print medium, image receiving medium, or, in the case of an inkjet recording apparatus, an ejection medium or ejection receiving medium, or the like). This term includes various types of media, irrespective of material and size, such as continuous paper, cut paper, sealed paper, resin sheets, such as OHP sheets, film, cloth, an intermediate transfer body, a printed circuit board on which a wiring pattern, or the like, is printed by means of an inkjet recording apparatus, and the like.

The "conveyance device" may include a mode where the recording medium is conveyed with respect to a stationary (fixed) recording head, or a mode where a recording head is moved with respect to a stationary recording medium, or a mode where both the recording head and the recording medium are moved. When forming color images, it is possible to provide type recording heads for each color of a plurality of colored inks (recording liquids), or it is possible to eject inks of a plurality of colors, from one recording head.

A desirable mode is one in which, at a position after the head located at the furthest downstream position of the plurality of recording heads, a radiation irradiation device (main curing device) is also provided for irradiating radiation to perform main curing of the ink droplets on the recording medium, to a level whereby no image deterioration is occasioned by subsequent handling.

After passing the last recording head, the ink droplets on the recording medium are cured (fixed completely) to a level which prevents image deterioration during subsequent handling, by irradiating radiation of relatively high energy required for main curing, by means of the main curing device.

Here, "handling" means, for example, (1) rubbing of the image surface against the rollers, conveyance guides, and the like, in the conveyance steps downstream of the main curing device, (2) rubbing between prints in the print stacking section, and (3) rubbing of a finished print against various objects when it is actually handled for use, and "main curing" means curing the liquid droplets to a level whereby no image deterioration is caused by handling of this kind. Therefore, "main curing" does not necessarily means that the curing reaction is fully completed.

Furthermore, in a case where an ultraviolet-curable ink is used in the present invention, desirably, the "radiation irradiation device" used for preliminary curing is constituted by an ultraviolet light source comprising a group of light-emitting elements arranged in a linear fashion. More specifically, since the ultraviolet irradiating device used for preliminary curing has a relatively low energy sufficient to cure the surface of the ink droplets on the recording medium by a certain amount, then it is appropriate to use light-emitting diode (LED) elements, laser diode (LD) elements, or the like, for the light-emitting elements, and hence these device can be achieved at low cost. Furthermore, in a group of linearly arranged light-emitting elements, it is possible to control the light emission selectively, at each light emitting element, and therefore, the number of light-emitting elements which light up, and the amount of light emitted, can be adjusted readily.

Preferably, the threshold cured film thickness is a value which yields sufficient film strength to prevent occurrence of landing interference between the previously deposited droplet and the subsequent droplet ejected subsequently in the overlapping fashion.

The value of the threshold cured film thickness is determined on the basis of conditions such as the type of ink, the irradiation energy, the type of recording medium, the ejected dot size, the dot pitch, and so on, but specific numerical values can be found previously by means of experimentation, or the like.

Preferably, the image forming apparatus further comprises: a conditions determination device which determines at least one condition, of a type of the ink, a type of the recording medium, and amount of radiation energy irradiated by the radiation irradiation device, wherein the droplet ejection timing control device sets the ejection interval according to information relating to the dot size and the dot pitch, and at least one parameter of the type of the ink, the type of the recording medium and the amount of radiation energy irradiated by the radiation irradiation device, as determined by the conditions determination device.

A desirable mode is one in which the relationships between the time period required to achieve a threshold cured film thickness (preliminary curing process time), and various conditions (including at least one of the following parameters: the type of ink, type of recording medium, irradiation energy, dot diameter, dot pitch, and the like) are stored in the form of a table, and an optimal (minimum necessary) droplet ejection interval is set by referring to the table data in accordance with the determined conditions.

Preferably, in cases where an image comprising a plurality of dot sizes is to be formed, the droplet ejection timing control device takes the ejection interval set between dots of the largest dot size as a representative value, and uses this representative value of the ejection interval for all of the dots.

When dots having the largest dot size overlap with the highest amount of overlap, then the droplet ejection interval for preventing landing interference becomes a maximum value. If an image is formed while varying the dot size within the same image (in other words, by using dots of a plurality of dot sizes), then the calculational load can be reduced by setting the droplet ejection interval for the image in accordance with the pattern in the image which has the longest droplet ejection interval.

Preferably, the ink ejection device comprises at least two heads which eject droplets of the ink of a same color, each of the at least two heads having a nozzle row in which nozzles for ejecting droplets of the ink are aligned in a main scanning direction that is substantially perpendicular to the relative movement direction, nozzle positions in the at least two heads in the main scanning direction being determined in such a manner that a row of mutually adjacent dots is formed in the main scanning direction by the droplets ejected from the nozzles of different nozzle rows of the at least two heads; and the image forming apparatus further comprises a head-to-head distance modification device which modifies a relative distance between the at least two heads in a sub-scanning direction that is parallel to the relative movement direction.

According to the present invention, the plurality of same-color nozzles for forming a row of dots which are mutually adjacent in the main scanning direction are divided into two or more nozzle rows, and the distance in the sub-scanning direction between the nozzle rows can be varied. The ejection interval between droplets which are mutually adjacent in the sub-scanning direction is controlled by controlling the relative speed of the conveyance device, and the ejection interval between droplets which are mutually adjacent in the main scanning direction is controlled by controlling the relative speed in the sub-scanning direction and by controlling the distance in the sub-scanning direction between the nozzle rows (namely, the relative distance between the heads). Accordingly, it is possible to prevent landing interference between droplets which are mutually adjacent in the sub-scanning direction and the main scanning direction.

In order to attain the aforementioned object, the present invention is also directed to an image forming method, comprising: a dot formation conditions determining step of determining a dot size of dots and a pitch between adjacent dots to be formed by ejected droplets, according to print data; a first dot forming step of forming a first dot by depositing a first droplet of radiation-curable ink onto a recording medium by ejecting the first droplet from a liquid ejection head according to the print data; a preliminarily curing step of curing a surface of the first droplet to a threshold cured film thickness by irradiating radiation onto the first droplet; and a second dot forming step of forming a second dot by depositing a second droplet of the radiation-curable ink onto the recording medium by ejecting the second droplet from the liquid ejection head, while setting an ejection interval between the first and second droplets according to the dot size and the dot pitch determined in the dot formation conditions determining step, and controlling an ejection timing of the second droplet, in such a manner that the second droplet is deposited to overlap with the first droplet, after a time period required for a surface of the first droplet to reach the threshold cured film thickness by means of the preliminary curing step has elapsed.

According to the present invention, since the droplet ejection interval is determined by focusing on the cured film thickness at the surface of a previously ejected droplet, and is set in such a manner that a sufficient preliminary curing time is ensured in order to obtain a cured film thickness that prevents landing interference, then it is possible to achieve optimal control of the droplet ejection which is suited to high-speed printing.

A mode is also possible in which a program is provided which causes a computer to execute the various steps of the above-described image forming method. In this case, the program for achieving the droplet ejection control functions of the present invention may be used as an operating program of a central processing unit (CPU) incorporated into a printer or the like, and it may also be used in a computer system, such as a personal computer.

Furthermore, the program may be constituted by stand-alone applicational software, or it may be incorporated as a part of another application, such as image editing software. This program can be stored in a CD-ROM, a magnetic disk, or other information storage medium, and the program may be provided to a third party by means of such an information storage medium, or a download service for the program may be offered by means of a communications circuit, such as the Internet.

According to the present invention, it is possible to set an optimal droplet ejection interval which prevents landing interference, in accordance with conditions such as the dot size and dot pitch to be formed by ejected droplets, as ascertained on the basis of print data, and therefore, high-speed and high-quality printing becomes possible.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 3 is a table showing an embodiment of table data indicating the relationship between the time period Tth required until reaching a cured film thickness dth that avoids the occurrence of landing interference, and various conditions;

FIGS. 9A and 9B are diagrams showing a further composition of a light source section used in a preliminary curing light source, wherein FIG. 9A is a front view and FIG. 9B is a side view;

FIGS. 10A and 10B are diagrams showing a further composition of a light source section used in a preliminary curing light source, wherein FIG. 10A is a front view and FIG. 10B is a side view;

DETAILED DESCRIPTION OF THE PREFERRED EMBODIMENTS

Figure 1A:
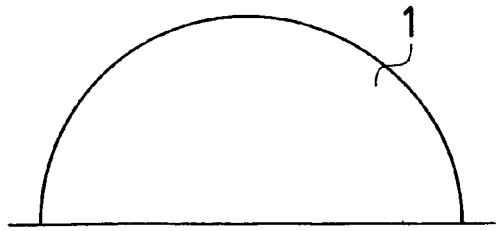
FIGS. 1A to 1E are schematic drawings showing progressive states of a curing reaction of a droplet of ultraviolet-curable ink, with the passage of time.

Description of Curing Process for Ultraviolet-Curable Ink

FIGS. 1A to 1E are schematic drawings showing the gradual progression, with the passage of time, of a curing reaction which progresses from the surface of the liquid toward the inner side as ultraviolet light is irradiated onto a droplet of ultraviolet-curable ink after it has been deposited on a recording medium. In FIGS. 1A to 1E, for the sake of convenience, the deposited liquid droplet is shown as having a hemispherical shape, but an actual liquid droplet will have a flatter shape than that shown in the drawings.

Figure 1B:
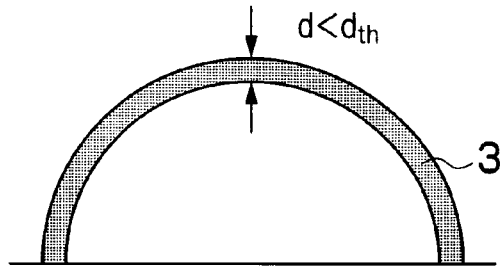

FIG. 1A shows a state immediately after the ultraviolet-curable ink droplet has landed on the recording medium. In this case, the whole of the ink droplet 1 is still in a liquid state. FIG. 1B shows a state where ultraviolet light has been irradiated onto the ink droplet and the region of the outermost surface of the ink droplet has undergone a curing reaction. In this state, the film thickness d of the cured portion is relatively thin (thinner than a threshold curing film thickness dth described hereinafter), and if a subsequent droplet is deposited to overlap with this droplet, then the cured surface film 3 will break and the ink droplets will mix together, thus giving rise to landing interference.

The "landing interference" referred to here is a phenomenon which occurs when respective ink droplets combine on the surface of the recording medium immediately after landing, thus changing the original independent shapes of the droplets and disrupting the shapes of the resulting dots. Between inks of different colors the problem of color mixing occurs when inks of different colors interfere with each other in sections where the dots are not supposed to be overlapping. Even in the case of inks of the same color, the prescribed dot shape (for example, an ideal circular shape) is lost, and hence the image is degraded. Landing interference is a particular problem in cases where droplets are deposited to form mutually adjacent dots at short time intervals (at high speed).

Figure 1C:
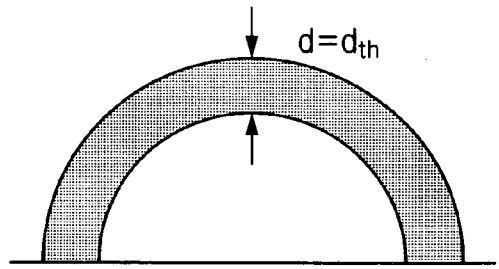
Figure 1D:
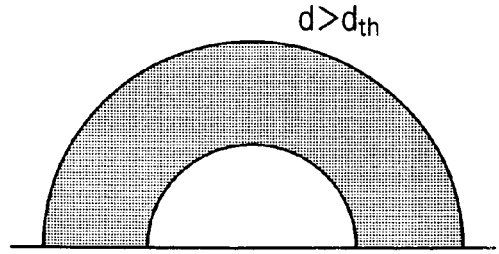
Figure 1E:
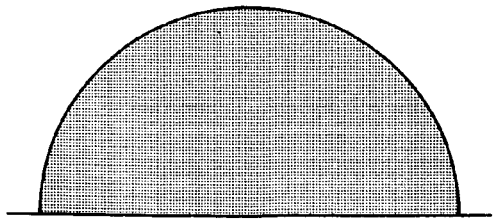

In FIG. 1C, the curing reaction has progressed from the state in FIG. 1B further toward the inside from the droplet surface, and the cured film thickness d becomes larger. As described in more detail below, when the curing film thickness d reaches the threshold curing film thickness dth, then the ink droplets will not combine and landing interference will not occur, even if a subsequent droplet is deposited to overlap with this droplet. As shown in FIGS. 1D and 1E, when further ultraviolet light is irradiated, the curing reaction progresses toward the inside and eventually, the droplet becomes completely cured.

However, if a leveling process (processing for evening out undulations in the image surface), or the like, is to be carried out after the end of printing, then a mode can be adopted in which the irradiation of ultraviolet light is halted once the cured film thickness d reaches the threshold cured film thickness dth, leveling is carried out after deposition of ink droplets of the respective colors has been completed, and main curing is then performed by restarting the irradiation of ultraviolet light with respect to all of the ink.

Figure 2B:
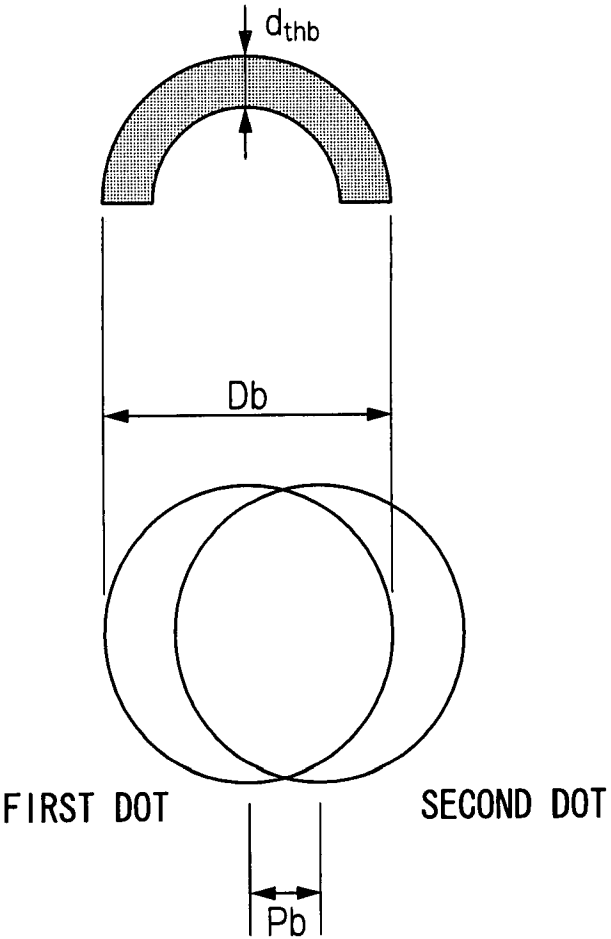
FIGS. 2A and 2B are schematic drawings for describing the relationship between the cured film thickness which avoids the occurrence of landing interference and amount of overlap between dots.
Figure 2A:
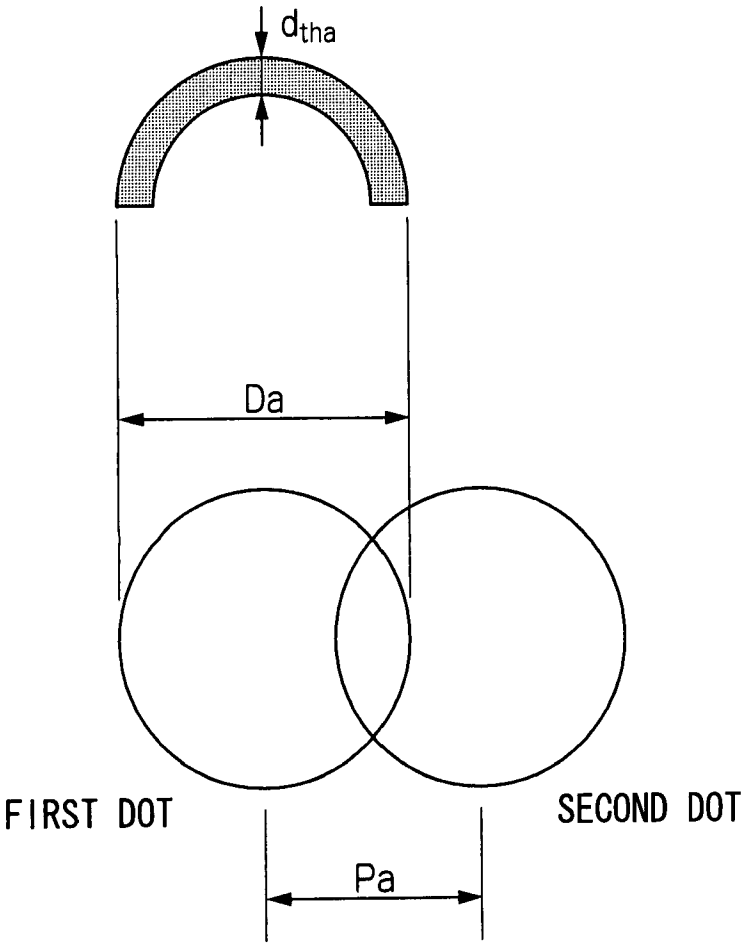

The threshold cured film thickness value, dth, at which landing interference does not occur is determined on the basis of the experimentation, and is determined in accordance with conditions, such as the type of ink, the UV irradiation energy, the type of recording medium (since the viscous strength at the interface between the ink and paper is governed by the angle of contact between the cured thin film and the recording medium), the deposited droplet size, the pitch between dots formed by the deposited droplets, and the like. As shown in FIGS. 2A and 2B, if a second droplet is deposited in such a manner that it overlaps partially with a first droplet, then the cured film thickness, dth, at which landing interference will not occur between the first droplet and the second droplet is dependent on the amount of overlap between the first droplet and the second droplet.

FIG. 2A shows a case where the amount of overlap is relatively small, and the cured film thickness of the first droplet which prevents occurrence of landing interference is dtha. On the other hand, FIG. 2B shows a case where the amount of overlap is relatively large, and the cured film thickness of the first droplet which prevents occurrence of landing interference is dthb. If the droplet diameter of the first droplet and the second droplet in FIG. 2A is taken to be Da, and the droplet pitch (distance between droplet centers) is taken to be Pa, then the amount of overlap between the droplets can be expressed as Da/Pa. Similarly, if the droplet diameter of the first droplet and the second droplet in FIG. 2B is taken to be Db, and the droplet pitch (distance between droplet centers) is taken to be Pb, then the amount of overlap between the droplets can be expressed as Db/Pb (where Da/Pa<Db/Pb).

In the case shown in FIG. 2B, the weight load exerted on the first droplet by the second droplet is greater than in the case shown in FIG. 2A, and therefore, the cured film thickness required to prevent landing interference is larger. Therefore, dtha<dthb.

In this way, the cured film thickness dth for preventing landing interference varies with the amount of overlap between the first droplet and the second droplet, in other words, with the conditions of the droplet diameter and the droplet pitch. In FIGS. 2A and 2B, in order to simplify the description, the first droplet and the second droplet are shown as having the same droplet diameter (droplet size), but the same applies to cases where the first droplet and the second droplet have different droplet diameters, the conditions of the cured film thickness, dth, being determined in accordance with the droplet diameter and droplet pitch conditions of each of the droplets.

In practice, a table such as that shown in FIG. 3 is created to indicate the time period Tth required after ejection of a droplet until a threshold cured film thickness value, dth, is achieved. The table is stored in a memory, or the like, and is used to control the droplet ejection timing of the respective dots.

In other words, the value of the cured film thickness which prevents landing interference is dependent on conditions such as the type of ink, the type of recording medium, the UV irradiation energy, the droplet diameter of the previously deposited droplet (first droplet), the droplet diameter of the subsequent deposited droplet (second droplet) which overlaps with the first droplet, the droplet pitch, and the like, and therefore the droplet ejection interval (Tth) required to achieve the threshold cured film thickness is calculated by using a table such as that shown in FIG. 3, on the basis of these conditions.

General Composition of Inkjet Recording Apparatus

Figure 4:
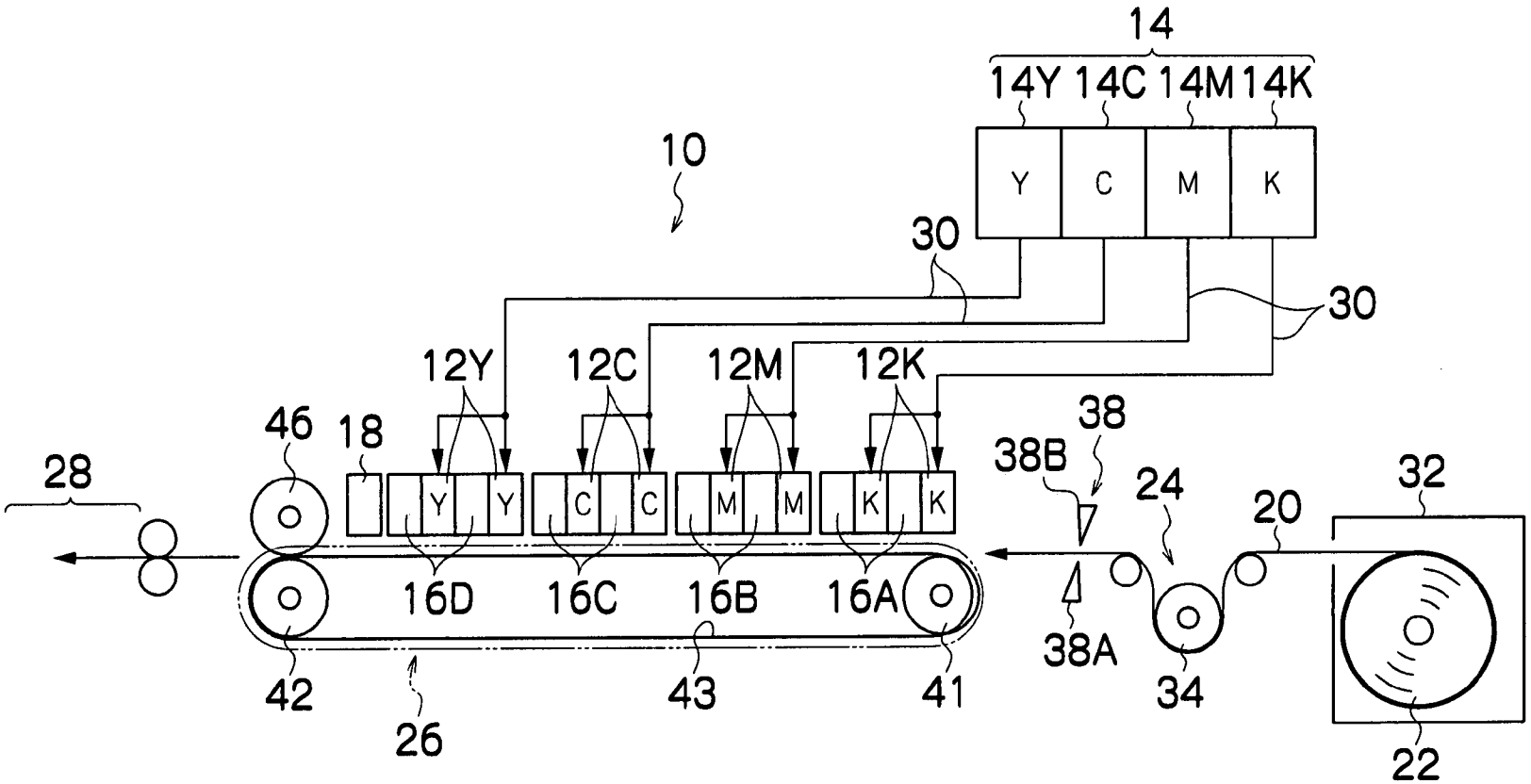
FIG. 4 is a general schematic drawing of an image forming apparatus relating to an embodiment of the present invention.

FIG. 4 is a diagram of the general composition of an image forming apparatus according to an embodiment of the present invention. As shown in FIG. 4, this image forming apparatus 10 comprises a plurality of inkjet recording heads (corresponding to "ink ejection devices" or "liquid ejection heads"; hereinafter, called "heads") 12K, 12M, 12C, 12Y provided corresponding to respective ink colors; an ink storing and loading unit 14 for storing ultraviolet-curable ink (so-called "UV ink") to be supplied to the heads 12K, 12M, 12C and 12Y; preliminary curing light sources (corresponding to "radiation irradiation devices") 16A, 16B, 16C and 16D which irradiate ultraviolet light for performing preliminary curing until deposited ink droplets reach a threshold cured film thickness; a main curing light source 18 disposed after the head of the last color 12Y; a paper supply unit 22 for supplying recording paper 20 forming a recording medium, a decurling unit 24 for removing curl in the recording paper 20; a suction belt conveyance unit 26, disposed facing the nozzle faces (ink ejection faces) of the heads 12K, 12M, 12C, 12Y and the light emitting faces of the light sources (16A to 16D and 18), for conveying the recording paper 20 while keeping the recording paper 20 flat; and a paper output unit 28 for outputting recorded recording paper (printed matter) to the exterior.

Ultraviolet-curable ink is an ink containing a component which hardens (polymerizes) upon application of ultraviolet energy (namely, an ultraviolet-curable component, such as a monomer, oligomer, or a low-molecular-weight homopolymer, copolymer, or the like), and a polymerization initiator. The ink therefore has a property whereby, when ultraviolet light is irradiated onto the ink, it starts to polymerize and as the polymerization progress, the ink gradually hardens from the liquid surface toward the inside.

The ink storing and loading unit 14 has ink tanks 14K, 14M, 14C, 14Y for storing the inks of the colors corresponding to the heads 12K, 12M, 12C and 12Y, and the tanks are connected to the heads 12K, 12C, 12M, and 12Y through prescribed channels 30. In other words, the ink storing and loading unit 14, together with the tubing channels 30, forms an ink supply device which supplies ultraviolet-curable ink to the respective heads 12K, 12M, 12C and 12Y. The ink storing and loading unit 14 also comprises a warning device (for example, a display device or an alarm sound generator) for warning when the remaining amount of any ink is low, and has a mechanism for preventing loading errors between different colors.

In FIG. 4, a magazine 32 for rolled paper (continuous paper) is shown as an embodiment of the paper supply unit 22; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 20 delivered from the paper supply unit 22 retains curl due to having been loaded in the magazine 32. In order to remove the curl, heat is applied to the recording paper 20 in the decurling unit 24 by a heating drum 34 in the direction opposite from the curl direction in the magazine 32. The heating temperature at this time is preferably controlled so that the recording paper 20 has a curl in which the surface on which the print is to be made is slightly round outward.

In the case of the configuration in which roll paper is used, a cutter 38 is provided as shown in FIG. 4, and the continuous paper is cut into a desired size by the cutter 38. The cutter 38 has a stationary blade 38A, whose length is not less than the width of the conveyor pathway of the recording paper 20, and a round blade 38B, which moves along the stationary blade 38A. The stationary blade 38A is disposed on the reverse side of the printed surface of the recording paper 20, and the round blade 38B is disposed on the printed surface side across the conveyor pathway. When cut papers are used, the cutter 38 is not required.

The decurled and cut recording paper 20 is delivered to the suction belt conveyance unit 26. The suction belt conveyance unit 26 has a configuration in which an endless belt 43 is set around rollers 41 and 42 so that the portion of the endless belt 43 facing at least the nozzle face of the heads 12K, 12M, 12C, and 12Y forms a horizontal plane (flat plane).

The belt 43 has a width that is greater than the width of the recording paper 20, and a plurality of suction apertures (not shown) are formed on the belt surface. A suction chamber (not illustrated) is provided on the inner side of the belt 43 set about the rollers 41 and 42, and the recording paper 20 is suctioned and held on the belt 43 by creating a negative pressure by suctioning the suction chamber with a fan. It is also possible to use an electrostatic attraction method, instead of an electrostatic attraction method.

The belt 43 is driven in the counterclockwise direction in FIG. 4 by the motive force of a motor 134 (not shown in FIG. 4, but shown in FIG. 11) being transmitted to at least one of the rollers 41 and 42, which the belt 43 is set around, and the recording paper 20 held on the belt 43 is conveyed from right to left in FIG. 3.

The heads 12K, 12M, 12C and 12Y are full line heads having a length corresponding to the maximum width of the recording paper 20 used with the image forming apparatus 10, and comprising a plurality of nozzles for ejecting ink arranged on a nozzle face through a length exceeding at least one edge of the maximum-size recording paper 20 (namely, the full width of the printable range).

The heads 12K, 12M, 12C and 12Y are arranged in color order (black (K), magenta (M), cyan (C), yellow (Y)) from the upstream side in the feed direction of the recording paper 20, and these respective heads 12K, 12M, 12C and 12Y are arranged extending in a direction substantially perpendicular to the conveyance direction of the recording paper 20.

Figure 5:
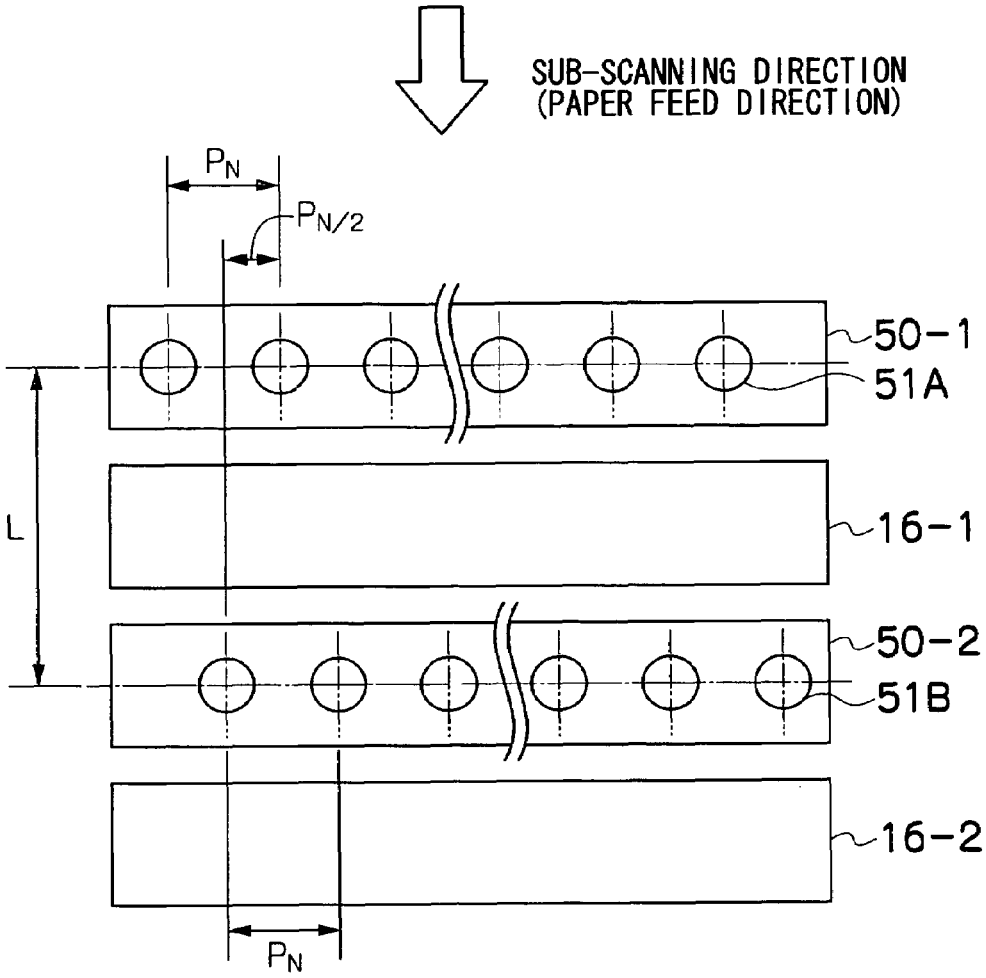
FIG. 5 is a general schematic drawing of a head as viewed from the side of the nozzle surface.

Two heads 12K, 12M, 12C or 12Y are provided respectively for each ink color, and the respective nozzle rows are arranged in a mutually staggered configuration (see FIG. 5). Furthermore, as shown in FIG. 4, the preliminary curing light sources 16A to 16D are disposed on the downstream sides of the heads 12K, 12M, 12C and 12Y, in such a manner that ultraviolet light is irradiated from the preliminary curing light sources 16A to 16D onto the ink droplets immediately after they have landed on the medium.

The preliminary curing light sources 16A to 16D have a length corresponding to the maximum width of the recording paper 20, similarly to the heads 12K, 12M, 12C and 12Y, and they are fixed extending in a direction substantially perpendicular to the conveyance direction of the recording paper 20. The preliminary curing light sources 16A to 16D respectively apply irradiated UV energy of a level for curing to a prescribed thickness, onto the surface of the ink droplets ejected from the head 12K, 12M, 12C and 12Y disposed adjacently on the upstream side thereof. In this case, curing of the ink inside the nozzles of the heads 12K, 12M, 12C and 12Y is prevented by ensuring that irradiation energy is not applied in excess of the required amount (in other words, by applying the minimum necessary amount of irradiation energy).

More specifically, the preliminary curing light sources 16A to 16D each have the function of preliminarily curing (semi-curing) ink droplets deposited on the recording medium 20 by a preceding head 12K, 12M, 12C or 12Y, thereby curing the surface of the deposited ink droplet to a prescribed thickness in such a manner that the deposited ink droplets do not combine on the surface of the recording medium with ink droplets of the same color or a different color ejected from a subsequent head 12K, 12M, 12C or 12Y (in other words, in such a manner that landing interference does not occur). The UV light irradiated from the preliminary curing light sources 16A to 16D is directed toward the vicinity of the droplet landing position in the preceding head 12K, 12M, 12C, 12Y, and is therefore incident on the surface of the recording medium at an oblique angle, in such a manner that the irradiated UV light strikes the dots immediately after they have been deposited.

A color image can be formed on the recording paper 20 by ejecting inks of different colors from the heads 12K, 12C, 12M and 12Y, respectively, onto the recording paper 20 while the recording paper 20 is conveyed by the suction belt conveyance unit 26. By adopting a configuration in which full line heads 12K, 12M, 12C and 12Y having nozzle rows covering the full paper width are provided for separate colors in this way, it is possible to record an image on the full surface of the recording medium 20 by performing just one operation of moving the recording medium 20 relatively with respect to the heads 12K, 12M, 12C and 12Y in the paper conveyance direction (the sub-scanning direction), (in other words, by means of one sub-scanning action). A single pass image forming apparatus 10 of this kind is able to print at high speed in comparison with a shuttle scanning system in which an image is printed by moving a recording head back and forth reciprocally in the main scanning direction, and hence print productivity can be improved.

Although the configuration with the KCMY four standard colors is described in the present embodiment, combinations of the ink colors and the number of colors are not limited to those. Light inks or dark inks can be added as required. For example, a configuration is possible in which inkjet heads for ejecting light-colored inks such as light cyan and light magenta are added. Furthermore, there are no particular restrictions of the sequence in which the heads of respective colors are arranged.

After passing the yellow head 12Y, ultraviolet light of sufficient energy to harden (fully cure) the ink droplets on the recording paper 20 is irradiated by the main curing light source 18, thereby perform main curing in such a manner that no deterioration of the image is caused by subsequent handling (in downstream stages).

A pressurizing and fixing roller 46 is provided on the downstream side of the main curing light source 18. The pressurizing and fixing roller 46 is a device for controlling the glossiness and evenness of the image surface. The printed object generated in this manner is output through the paper output unit 28. Although not shown in FIG. 4, the paper output unit 28 is provided with a sorter for collecting images according to print orders.

Furthermore, instead of the composition shown in FIG. 4, it is also possible to adopt a composition in which the main curing light source 18 is disposed on the downstream side of the pressurizing and fixing roller 46.

Structure of Head

Next, the structure of a head will be described. The heads 12K, 12M, 12C and 12Y provided for the respective ink colors have the same structure, and a reference numeral 50 (or 50-1, 50-2) is hereinafter designated to any of the heads.

FIG. 5 is a diagram showing heads 50 viewed from the nozzle surface side. As shown in FIG. 5, the print unit for each color comprises a front row head 50-1 and a rear row head 50-2, and preliminary curing light sources 16-1 and 16-2 are disposed immediately after these heads 50-1 and 50-2, respectively. In FIG. 5, the front row head 50-1, the rear row head 50-2, and the preliminary curing light sources 16-1 and 16-2 are depicted as mutually separate elements, but in the composition of an actual apparatus, it is also possible to adopt a mode in which the front row head 50-1 and preliminary curing light source 16-1 following same are formed integrally (namely, a mode where the ultraviolet light source is incorporated into the head), or a mode where the rear row head 50-2 and the preliminary curing light source 16-2 following same are formed integrally.

In the front row head 50-1 and the rear row head 50-2, a plurality of nozzles 51A and 51B are provided in one row, aligned in a direction substantially perpendicular to the recording medium conveyance direction. The nozzle pitch between the nozzles 51A provided in the front row head 50-1 (nozzle pitch $P_N$), and the nozzle pitch between the nozzles 51B provided in the rear row head 50-2 are the same. Furthermore, the relative positions of the front row head 50-1 and the rear row head 50-2 are set in such a manner that the nozzles 51B in the rear row head 50-2 are located at the intermediate positions between the adjacent nozzles 51A of the front row head 50-1 (in such a manner that the nozzles 51A and 51B form a staggered arrangement).

By arranging the nozzles 51A of the front row head 50-1 and the nozzles 51B of the rear row head 50-2 in a staggered arrangement, mutually displaced by ½ of the pitch ($P_N/2$), in this way, the effective nozzle pitch in the nozzle row direction (here, the main scanning direction) is $P_N/2$. A mode is also possible in which the heads each have a plurality of rows (in other words, they are divided into three or more nozzle rows), thereby further reducing the pitch between the nozzles in the main scanning direction. In this case also, the heads and preliminary curing light sources are disposed in mutually alternating fashion, in the sub-scanning direction (the recording medium conveyance direction).

In the case of the structure shown in FIG. 5, dots formed by droplets ejected from the front row head 50-1 and dots formed by droplets ejected from the rear row head 50-2 are aligned alternately in the main scanning direction, thereby forming a row of dots in the main scanning direction. In other words, the odd-numbered dots are formed by the front row head 50-1 and the even-numbered dots are formed by the rear row head 50-2.

The front row head 50-1 and the rear row head 50-2 according to the present embodiment are composed so as to be movable with respect to each other in the conveyance direction of the recording paper, in such a manner that the interval (relative distance) L between the two heads (nozzles rows) can be altered. For example, there is a mode in which a head movement mechanism 129 (not shown in FIG. 5, but shown in FIG. 11) comprising a motor and conveyance mechanisms and guide members, such as a ball screw or slide rail, is provided in the front row head 50-1 and the front row head 50-1 is moved with respect to a fixed rear row head 50-2, and a mode in which the head movement mechanism 129 as described above is provided in both the front row head 50-1 and the rear row head 50-2 in such a manner that both of the heads are movable. Of course, it is also possible for the front row head 50-1 to be fixed and the rear row head 50-2 to be moveable.

The front row head 50-1 and the rear row head 50-2 shown in FIG. 5 may be constituted respectively by single long heads, or alternatively, line heads having nozzle rows of a length corresponding to the full width of the recording medium may be composed by joining together a plurality of relatively short head modules.

Figure 6:
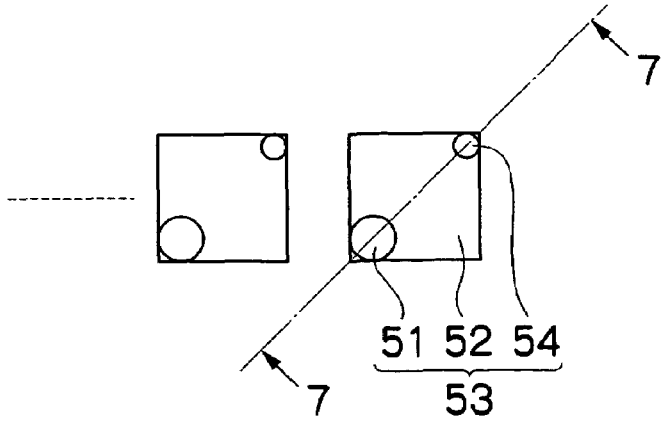
FIG. 6 is a plan diagram of a pressure chamber formed in a head.
Figure 7:
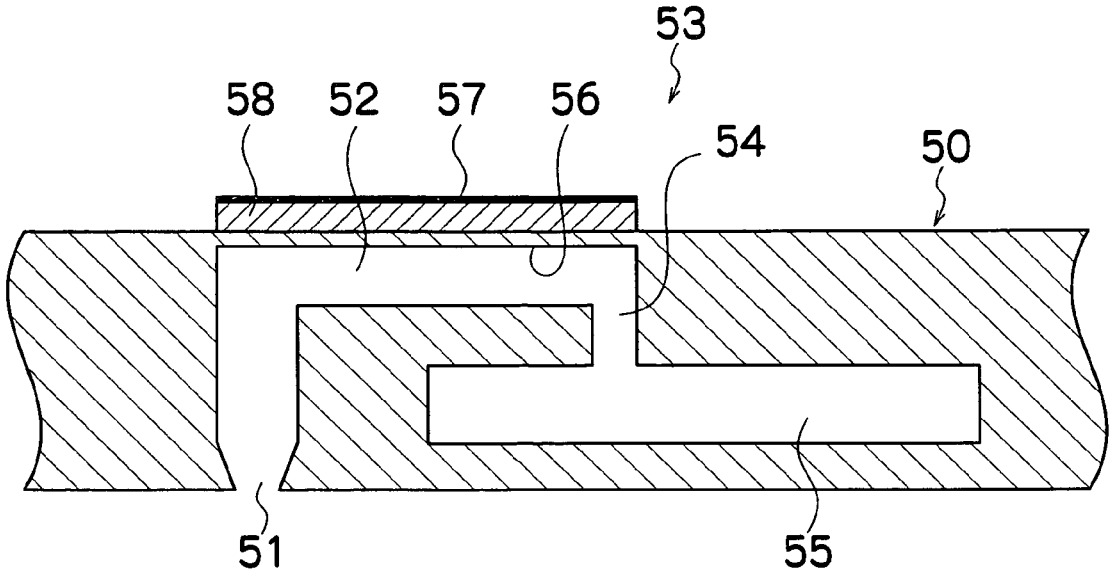
FIG. 7 is a cross-sectional diagram showing the three-dimensional composition of one liquid droplet ejection element.

FIG. 6 is a plan diagram of a pressure chamber formed in a head; and FIG. 7 is a cross-sectional diagram (along line 7-7 in FIG. 6) showing the three-dimensional composition of one of the liquid droplet ejection elements (an ink chamber unit corresponding to one nozzle 51).

As shown in FIG. 6, a plurality of ink chamber units (liquid droplet ejection elements) 53 are formed in the head 50, each ink chamber unit comprising a nozzle 51, which is an ink droplet ejection port, a pressure chamber 52 corresponding to the nozzle 51, and a supply port 54 for supplying ink to the pressure chamber 52. As shown in FIG. 6, the planar shape of the pressure chamber 52 provided to correspond to each nozzle 51 is substantially a square shape, and the nozzle 51 and an inlet for supplying ink (supply port) 54 are disposed in respective corners on a diagonal line of the square shape. The shape of the pressure chamber 52 is not limited to that of the present embodiment and various modes are possible in which the planar shape is a quadrilateral shape (rhombic shape, rectangular shape, or the like), a pentagonal shape, a hexagonal shape, or other polygonal shape, or a circular shape, elliptical shape, or the like.

Furthermore, as shown in FIG. 7, each pressure chamber 52 is connected to a common flow channel 55 through the supply port 54. The common flow channel 55 is connected to an ink tank (not shown in FIG. 7, but equivalent to reference numeral 14 in FIG. 4), which is a base tank that supplies ink, and the ink supplied from the ink tank is delivered through the common flow channel 55 shown in FIG. 7 to the pressure chambers 52.

An actuator 58 provided with an individual electrode 57 is bonded to a pressure plate (a diaphragm that also serves as a common electrode) 56 which forms the surface of one portion (in FIG. 7, the ceiling) of the pressure chambers 52. When a drive voltage is applied to the individual electrode 57 and the common electrode, the actuator 58 deforms, thereby changing the volume of the pressure chamber 52. This causes a pressure change which results in ink being ejected from the nozzle 51. For the actuator 58, it is possible to use a piezoelectric element using a piezoelectric body, such as lead zirconate titanate, barium titanate, or the like. When the displacement of the actuator 58 returns to its original position after ejecting ink, new ink is supplied to the pressure chamber 52 from the common flow channel 55 through the supply port 54.

In implementing the present invention, the arrangement of the nozzles is not limited to that of the embodiment illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Compositional Embodiment of Preliminary Curing Unit

Figure 8:
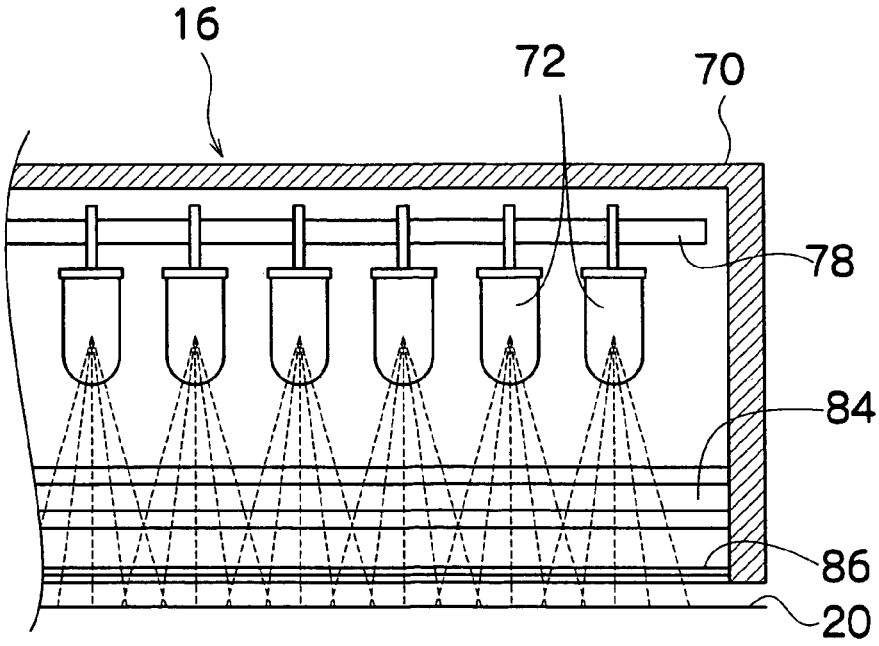
FIG. 8 is a cross-sectional diagram showing an embodiment of the structure of a preliminary curing light source.

Here, an embodiment of the structure of the preliminary curing light sources 16A to 16D will be described (hereinafter, the respective light sources are indicated generally by the reference numeral 16, in order to simplify the description). FIG. 8 is a cross-sectional diagram showing an embodiment of the structure of the preliminary curing light source 16. The preliminary curing light source 16 has a structure in which a plurality of ultraviolet LED elements 72 are arranged in a line following the lengthwise direction of the head 50, within a light shroud 70, and a condensing cylindrical lens 84 is provided below the row of ultraviolet LED elements 72.

A slit-shaped opening section 86 forming a light emission aperture is provided in the bottom part of the light shroud 70, in such a manner that ultraviolet light condensed into a line shape is irradiated onto the recording paper 20 through the opening 86. Reference numeral 78 denotes a substrate on which the ultraviolet LED elements 72 are supported.

Scattered light generated by the group of ultraviolet LED elements 72 is condensed into a linear shape in a direction substantially perpendicular to the paper conveyance direction, by the action of the cylindrical lens 84, and the light is irradiated onto the recording paper 20. Instead of the cylindrical lens 84, it is also possible to use a lens group having one or more aspherical surface shaped to achieve refraction of the light, having a condensing power similar to that of the cylindrical lens 84.

Desirably, the light emission positions and the emitted light intensities of the ultraviolet LED elements 72 are controlled suitably in accordance with the size of the recording paper 20 and the droplet ejection range of the head 50, in such a manner that the minimum necessary amount of light is generated, thereby minimizing adverse effects on the head 50.

Figure 9A:
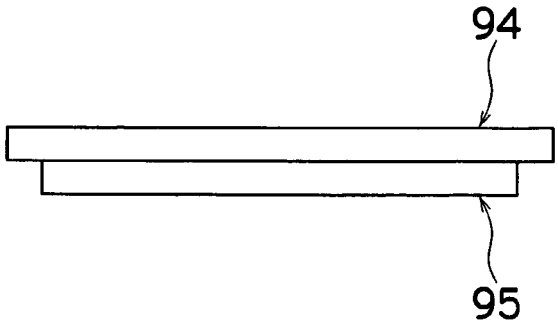
Figure 9B:
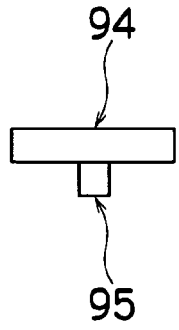
Figure 10A:
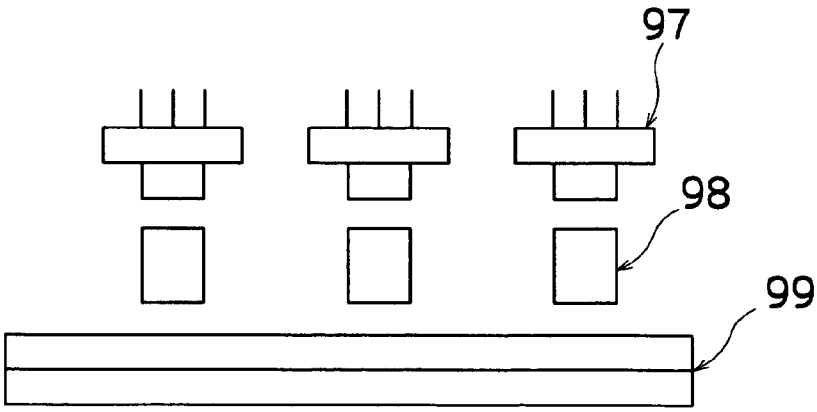
Figure 10B:
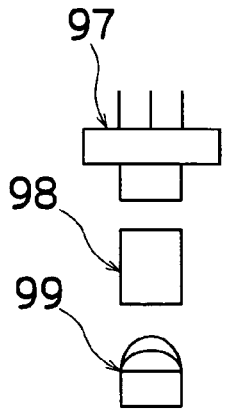

The composition of the preliminary curing light sources 16 is not limited to one using lamp-type ultraviolet LED elements 72 aligned in an array such as that shown in FIG. 8, and it is also possible to arrange an LED element 95 one-dimensionally on a substrate 94, as shown in FIGS. 9A and 9B. Furthermore, a composition using LD (laser diode) elements instead of LED elements may also be adopted. Furthermore, in place of the light source unit including a row of lamp-type ultraviolet LED elements 72 such as that illustrated in FIG. 8, it is also possible to substitute a light source unit including LD elements 97, a condensing lens 98 and a cylindrical lens 99, as shown in FIGS. 10A and 10B.

The curing process performed by the preliminary curing light source 16 should cure the ink surface to the threshold cured film thickness, dth, in order to prevent combination of ink droplets of the same color or different colors on the surface of the recording medium (recording paper 20) due to interference between the droplets. Therefore, desirably, different light sources are used for the preliminary curing light sources 16 and for the main curing light source 18, and the relationship between the preliminary curing light source 16 and the main curing light source 18 satisfies at least one of the following conditions:

Condition 1: "wavelength width of preliminary curing light source 16"<"wavelength width of main curing light source 18";

Condition 2: "light intensity irradiated by preliminary curing light source 16"<"light intensity irradiated by main curing light source 18"; and Condition 3: "irradiation range of curing light source 16"<"irradiation range of main curing light source 18".

Here, the central wavelengths and the wavelength widths of the preliminary curing light sources 16 and the main curing light source 18 are selected in accordance with the design specifications of the ink used.

In the main curing light source 18 following the yellow head 12Y shown in FIG. 4, it is possible to use an ultraviolet LED element array, similarly to the preliminary curing light sources 16, but it is also possible to use a mercury lamp or metal halide lamp, or the like, as appropriate, in the main curing light source 18. The main curing light source 18 has a broader wavelength width than the ultraviolet LED elements 72, and it outputs a greater amount of light. Furthermore, desirably, a light shielding partition member for preventing the light irradiated by the main curing light source 18 from entering into the yellow head 12Y is provided between the yellow head 12Y and the main curing light source 18.

Description of Control System

Next, the control system of the image forming apparatus 10 will be described.

Figure 11:
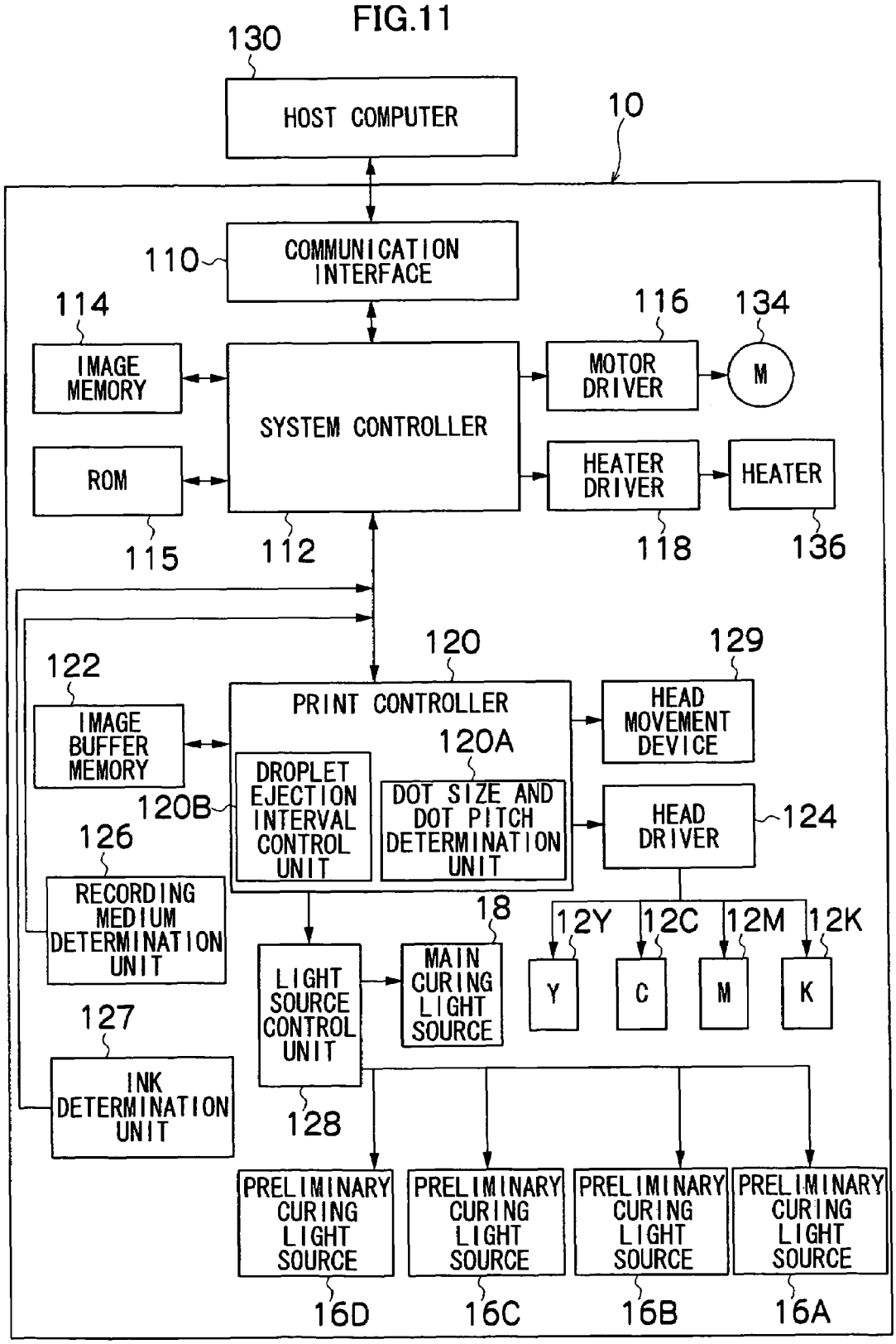
FIG. 11 is a principal block diagram showing the system configuration of the inkjet recording apparatus.

FIG. 11 is a principal block diagram showing the system composition of the image forming apparatus 10. The image forming apparatus 10 comprises a communication interface 110, a system controller 112, an image memory 114, a ROM 115, a motor driver 116, a heater driver 118, a print controller 120, an image buffer memory 122, a head driver 124, a recording medium determination unit 126, an ink determination unit 127, a light source control unit 128, the head movement mechanism 129, and the like.

The communication interface 110 is an interface unit for receiving image data sent from a host computer 130. A serial interface such as USB, IEEE1394, Ethernet, wireless network, or a parallel interface such as a Centronics interface may be used as the communication interface 110. A buffer memory (not shown) may be mounted in this portion in order to increase the communication speed. The image data sent from the host computer 130 is received by the image forming apparatus 10 through the communication interface 110, and is temporarily stored in the image memory 114.

The image memory 114 is a storage device for temporarily storing images inputted through the communication interface 110, and data is written and read to and from the image memory 114 through the system controller 112. The image memory 114 is not limited to a memory composed of semiconductor elements, and a hard disk drive or another magnetic medium may be used.

The system controller 112 is constituted by a central processing unit (CPU) and peripheral circuits thereof, and the like, and it functions as a control device for controlling the whole of the image forming apparatus 10 in accordance with a prescribed program, as well as a calculation device for performing various calculations. More specifically, the system controller 112 controls the various sections, such as the communication interface 110, image memory 114, motor driver 116, heater driver 118, and the like, as well as controlling communications with the host computer 130 and writing and reading to and from the image memory 114 and ROM 115, and it also generates control signals for controlling the motor 134 and heater 136 of the conveyance system.

The program executed by the CPU of the system controller 112 and the various types of data which are required for control procedures are stored in the ROM 115. The table shown in FIG. 3 is also stored in the ROM 115. The ROM 115 may be a non-writeable storage device, or it may be a rewriteable storage device, such as an EEPROM. The image memory 114 is used as a temporary storage region for the image data, and it is also used as a program development region and a calculation work region for the CPU.

The motor driver 116 is a driver (drive circuit) which drives the motor 134 in accordance with instructions from the system controller 112. The heater driver 118 is a driver for driving the heater 136 of the heating drum 34, and other sections, in accordance with instructions from the system controller 112.

The print controller 120 is a control unit having a signal processing function for performing various treatment processes, corrections, and the like, in accordance with the control implemented by the system controller 112, in order to generate a signal for controlling printing from the image data in the image memory 114. The print controller 80 supplies the print data (dot data) thus generated to the head driver 124. The print controller 120 comprises a calculating unit (dot size and dot pitch determination unit 120A) which determines the dot size and dot pitch for each pixel, and a droplet ejection interval control unit 120B, and it controls droplet ejection to an optimal droplet ejection interval which avoids the occurrence of landing interference, on the basis of the dot size and dot pitch thus determined.

Prescribed signal processing is carried out in the print controller 120, and the ejection amount and the ejection timing of the ink droplets from the respective heads 12K, 12M, 12C and 12Y are controlled through the head driver 124, on the basis of the print data. By this means, prescribed dot size and dot positions can be achieved.

The print controller 120 is provided with the image buffer memory 122; and image data, parameters, and other data are temporarily stored in the image buffer memory 122 when image data is processed in the print controller 120. The aspect shown in FIG. 11 is one in which the image buffer memory 122 accompanies the print controller 120; however, the image memory 114 may also serve as the image buffer memory 122. Also possible is an aspect in which the print controller 120 and the system controller 112 are integrated to form a single processor.

To give a general description of the sequence of processing from image input to print output, image data to be printed (original image data) is input from an external source through a communications interface 110, and is accumulated in the image memory 114. At this stage, RGB image data is stored in the image memory 114, for example.

In this inkjet type image forming apparatus 10, an image which appears to have a continuous tonal graduation to the human eye is formed by changing the dot deposition density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 114 is sent to the print controller 120 through the system controller 112, and is converted to the dot data for each ink color by a commonly known half-toning technique, such as dithering or error diffusion, in the print controller 120.

In other words, the print controller 120 performs processing for converting the input RGB image data into dot data for the four colors of K, C, M and Y. In this way, the dot data generated by the print controller 120 is stored in the image buffer memory 122.

The head driver 124 outputs drive signals for driving the actuators 58 corresponding to the respective nozzles 51 of the heads 12K, 12M, 12C and 12Y, on the basis of the print data supplied by the print controller 120 (in other words, the dot data stored in the image buffer memory 122). A feedback control system for maintaining constant drive conditions in the head may be included in the head driver 124.

By supplying the drive signals output by the head driver 124 to the heads 12K, 12M, 12C and 12Y, ink is ejected from the corresponding nozzles 51. By controlling ink ejection from the heads 12K, 12M, 12C, 12Y in synchronization with the conveyance speed of the recording medium 20, an image is formed on the recording medium 20.

The recording medium determination unit 126 is a device for determining the type and size of the recording paper 20. This section uses, for example, a device for reading in information such as bar codes attached to the magazine 32 in the paper supply unit 22, or sensors disposed at a suitable position in the paper conveyance path (a paper width determination sensor, a sensor for determining the thickness of the paper, a sensor for determining the reflectivity of the paper, and so on). A suitable combination of these elements may also be used. Furthermore, it is also possible to adopt a composition in which information relating to the paper type, size, or the like, is specified by means of inputs made through a prescribed user interface, instead of or in conjunction with such automatic determination devices.

The ink determination unit 127 is a device which acquires information relating to the ink used (ink type information). More specifically, it is possible to use, for example, a device which reads in ink properties information from the shape of the cartridge in the ink tank (a specific shape which allows the ink type to be determined), or from a bar code or IC chip incorporated into the cartridge. Besides this, it is also possible for an operator to input the required information by means of a user interface.

The information acquired by the recording medium determination unit 126 and the ink determination unit 127 is conveyed to the system controller 112 and/or the print controller 120, where it is used for control of the ink droplet ejection timing, control of the preliminary curing light sources 16A to 16D, control of the head movement mechanism 129 (control of the head-to-head distance L shown in FIG. 5), and the like. More specifically, the system controller 112 or print controller 120, or a combination of the system controller 112 and the print controller 120 function as the "droplet ejection timing control device" and "dot formation conditions specification device" according to the present invention.

Furthermore, a combination of the recording medium determination unit 126, the ink determination unit 127, the system controller 112 and the print controller 120 function as the "conditions determination device" of the present invention.

The light source control unit 128 shown in FIG. 11 is constituted by a preliminary curing light source control circuit for controlling the on and off switching, lighting up positions, light emission intensities, and the like, of the preliminary curing light sources 16A to 16D; and a main curing light source control circuit for controlling the on and off switching, the light emission intensity, and the like, of the main curing light source 18. The light source control unit 128 controls the light emission by the respective light sources (16A, 16B, 16C, 18) in accordance with the commands from the print controller 120.

Control of Droplet Ejection Timing

Next, an embodiment of the control of droplet ejection timing in the image forming apparatus having the foregoing composition will be described.

In the image forming apparatus 10 according to the present embodiment, if dots formed on a recording paper 20 are to overlap with each other, then the droplet ejection timing is controlled in such a manner that the subsequent ink droplet is ejected when the previously ejected ink droplet has assumed the state shown in FIG. 1C (namely, the cured film thickness, d, on the surface of the droplet has reached the threshold value of dth).

Figure 12:
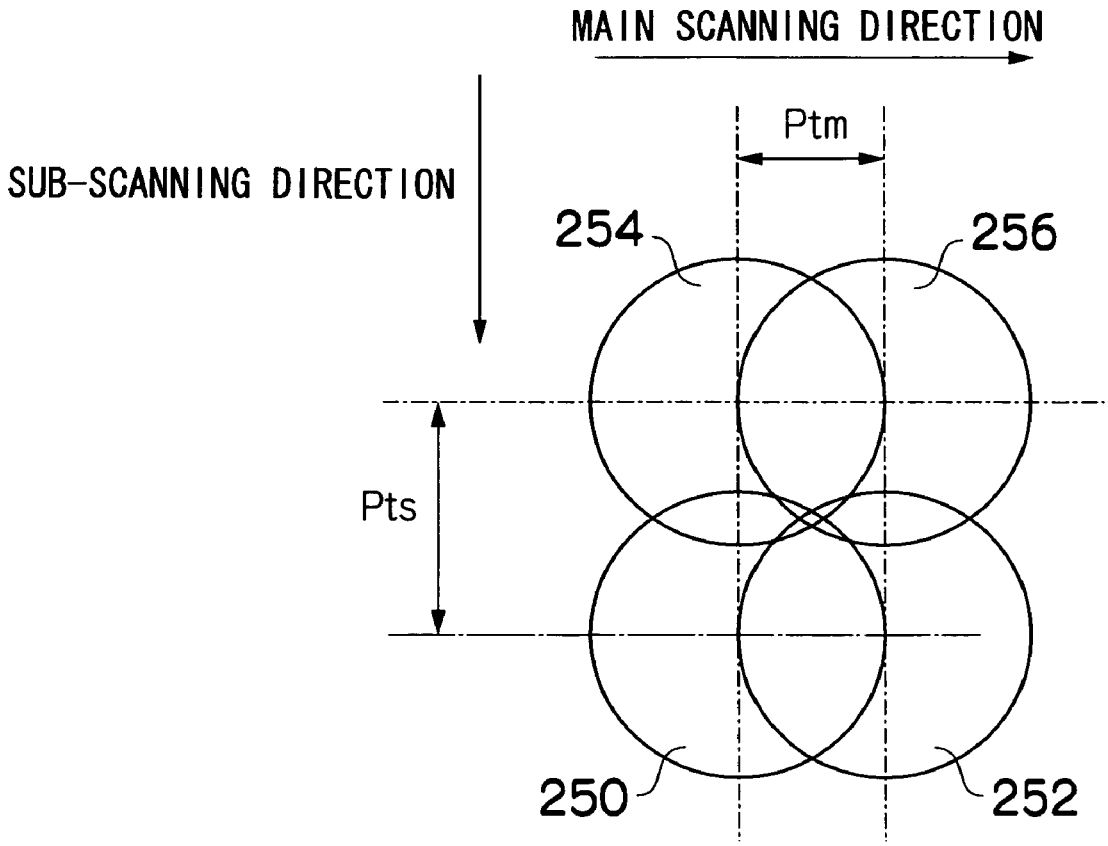
FIG. 12 is a diagram for describing the main scanning direction, the sub-scanning direction, and the droplet ejection interval.

As shown in FIG. 12, the droplet ejection interval δT1 between the droplets 250 and 254, or between the droplets 252 and 256, which are mutually adjacent in the sub-scanning direction, can be expressed as follows, in terms of the pitch between droplets Pts and the paper conveyance speed Vs:

$$\delta T1 = Pts/Vs. \quad (1)$$

Furthermore, the droplet ejection δT2 between the droplets 250 and 252, or between droplets 254 and 256, which are mutually adjacent in the main scanning direction, can be expressed as follows, in terms of the distance between heads (distance between nozzle rows) L shown in FIG. 5, and the paper conveyance speed Vs:

$$\delta T2 = L/Vs. \quad (2)$$

In order to prevent the occurrence of landing interference between adjacent droplets, it is necessary that the surface of the previously deposited droplet be cured to the threshold cured film thickness dth or above. The required time period Tth until reaching this threshold cured film thickness dth is recorded in a table in association with various conditions, as shown in FIG. 3, and therefore, by referring to this table, the droplet ejection timing between droplets in the sub-scanning direction and the droplet ejection timing between droplets in the main scanning direction are controlled in such a manner that both δT1 and δT2 are equal to or greater than Tth.

More specifically, in mathematical terms, $$\delta T1 = Pts/Vs \geqq Tth, \text{ and} \quad (3)$$

$$\delta T2 = L/Vs \geqq Tth, \quad (4)$$

and it is desirable to adopt the maximum value of the paper conveyance speed Vs which satisfies the following condition:

$$Vs \leqq Pts/Tth, \quad (5)$$

which is derived from Formula (3), (in other words, Vs=Pts/Tth), since this makes it possible to ensure printing speed.

Furthermore, a distance L which satisfies the following condition:

$$L \geqq Vs \times Tth, \quad (6)$$

which is derived from Formula (4), is used.

Figure 13:
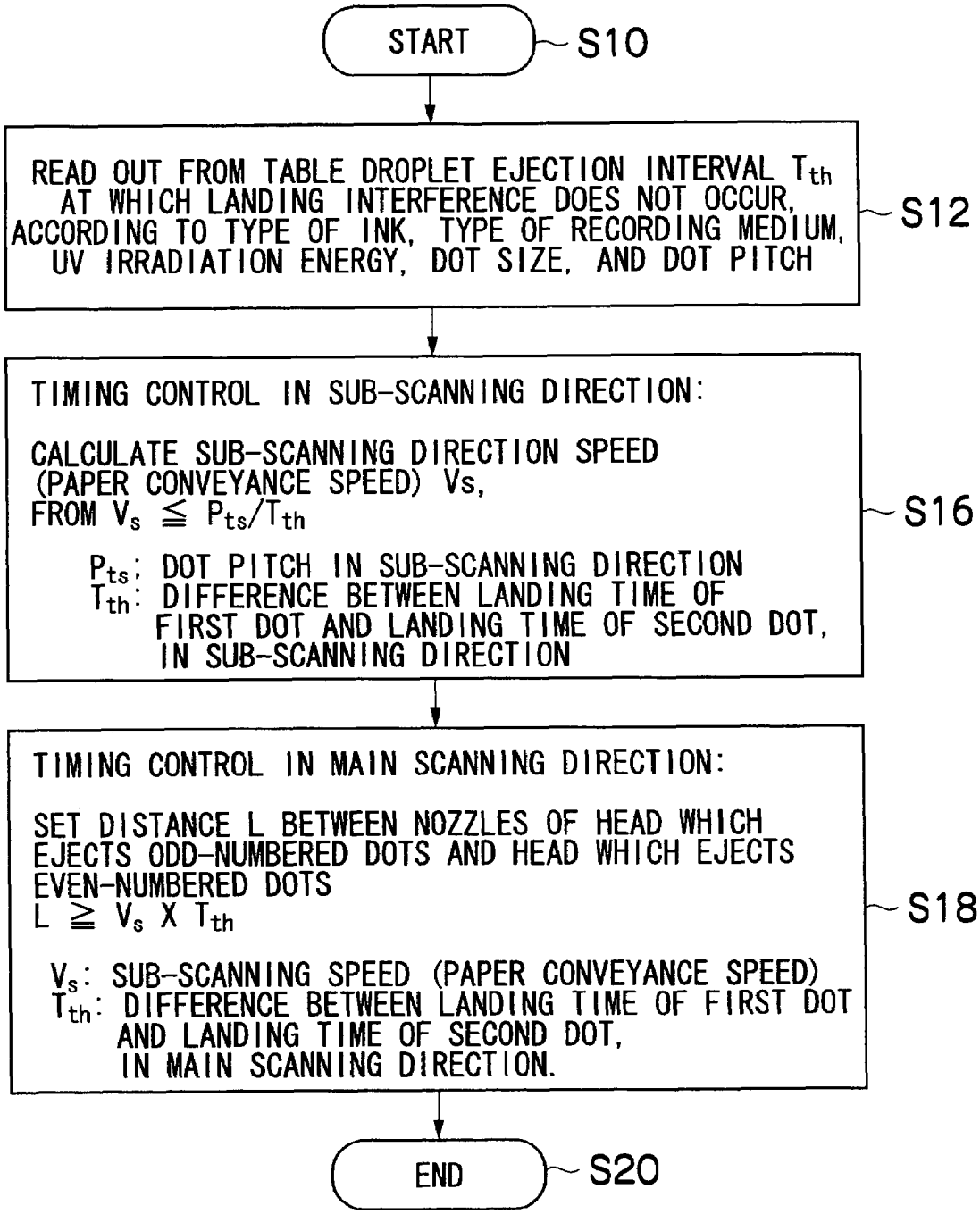
FIG. 13 is a flowchart showing the sequence of droplet ejection control in the image forming apparatus according to the present embodiment.

FIG. 13 is a flowchart showing the sequence of the droplet ejection timing control described above.

When image data is input and print control is started (step S10), the dot size and the dot pitch, and the like, are calculated on the basis of the dot data converted from the image data, and a value for the droplet ejection interval Tth which will not produce landing interference is read out from a table on the basis of the dot size and dot pitch information, and factors such as the type of ink, type of recording medium, UV irradiation energy, and the like (step S12).

Thereupon, timing control in the sub-scanning direction is executed (step S116). More specifically, the sub-scanning direction speed (paper conveyance speed) Vs is calculated from the above-described Formula (5), on the basis of the value of the droplet ejection interval Tth obtained at step S12, and the dot pitch Pts in the sub-scanning direction.

Thereupon, timing control in the main-scanning direction is executed (step S18). More specifically, the distance between the front row head 50-1 and the rear row head 50-2 shown in FIG. 5 (the distance between the nozzle rows) L is calculated by using the above-described Formula (6), and the distance between the heads is adjusted to the value L that satisfies Formula (6).

When an image has been formed while executing the timing control for the sub-scanning direction and the main scanning direction in this manner, the printing control sequence terminates (step S20).

According to the present embodiment, it is possible to eject a subsequent droplet immediately after preliminary curing of the surface of a previously ejected ink droplet to a threshold cured film thickness which avoids the occurrence of landing interference. Therefore, the printing time can be shortened. Furthermore, since a previously ejected ink droplet and a subsequently ejected ink droplet do not combine on the surface of the recording medium, there is no disturbance of the dot shapes and desired dot shapes can be obtained. Therefore, it is possible to form desirable images.

The present invention may also be applied to cases where mixed patterns combining different dot pitches and dot sizes are used in one image. In the case of a mixed pattern, the control operation can be simplified by determining respective values for the droplet ejection interval in the main scanning direction and the droplet ejection interval in the sub-scanning direction for all of the combinations of the dot pitches and the dot diameters, and then taking the maximum value of the droplet ejection intervals thus determined as a representative value of the droplet ejection interval for that image.

In mixed patterns comprising different dot sizes and dot pitches, the droplet ejection intervals may be determined for the respective patterns, and the maximum value of the droplet ejection interval is set as the droplet ejection interval for that image, or alternatively, a value obtained by adding a safety margin to this maximum value is set as the droplet ejection interval for that image.

The present embodiment is described with respect to a full line type print head, but the scope of application of the present invention is not limited to this, and it is also possible to apply the present invention to a (so-called shuttle-scanning type) image forming apparatus which uses a serial head that performs prints by scanning a relatively short print head reciprocally, back and forth, in a direction perpendicular to the conveyance direction of the recording medium.

Furthermore, the foregoing description related to an embodiment where ultraviolet-curable ink is used, but the implementation of the present invention is not limited to ultraviolet-curable ink, and an ink which is cured by the irradiation of an electron beam, X-ray, or other type of radiation, may be used, in which case a radiation irradiation device suitable for activating a curing reaction in the ink is provided, in accordance with the ink used.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an ink ejection device which ejects droplets of a radiation-curable ink onto a recording medium;

a conveyance device which causes the ink ejection device and the recording medium to move relatively to each other in a relative movement direction by conveying at least one of the ink ejection device and the recording medium;

a radiation irradiation device which irradiates radiation to the droplets deposited on the recording medium by the ink ejection device;

a dot formation conditions determination device which determines a dot size of dots and a pitch between adjacent dots to be formed by the ejected droplets, according to print data; and a droplet ejection timing control device which sets an ejection interval between the droplets according to information relating to the dot size and the dot pitch determined by the dot formation conditions determination device, and controls an ejection timing of a subsequent droplet ejected subsequently in an overlapping fashion, in such a manner that the subsequent droplet is ejected to form a dot overlapping with a dot formed by a droplet deposited previously on the recording medium, after a surface of the previously deposited droplet is preliminarily cured to a threshold cured film thickness by the radiation.

2. The image forming apparatus as defined in claim 1, wherein the threshold cured film thickness is a value which yields sufficient film strength to prevent occurrence of landing interference between the previously deposited droplet and the subsequent droplet ejected subsequently in the overlapping fashion.

3. The image forming apparatus as defined in claim 1, further comprising:

a conditions determination device which determines at least one condition, of a type of the ink, a type of the recording medium, and amount of radiation energy irradiated by the radiation irradiation device, wherein the droplet ejection timing control device sets the ejection interval according to information relating to the dot size and the dot pitch, and at least one parameter of the type of the ink, the type of the recording medium and the amount of radiation energy irradiated by the radiation irradiation device, as determined by the conditions determination device.

4. The image forming apparatus as defined in claim 1, wherein, in cases where an image comprising a plurality of dot sizes is to be formed, the droplet ejection timing control device takes the ejection interval set between dots of the largest dot size as a representative value, and uses this representative value of the ejection interval for all of the dots.

5. The image forming apparatus as defined in claim 1, wherein:

the ink ejection device comprises at least two heads which eject droplets of the ink of a same color, each of the at least two heads having a nozzle row in which nozzles for ejecting droplets of the ink are aligned in a main scanning direction that is substantially perpendicular to the relative movement direction, nozzle positions in the at least two heads in the main scanning direction being determined in such a manner that a row of mutually adjacent dots is formed in the main scanning direction by the droplets ejected from the nozzles of different nozzle rows of the at least two heads; and the image forming apparatus further comprises a head-to-head distance modification device which modifies a relative distance between the at least two heads in a sub-scanning direction that is parallel to the relative movement direction.

6. An image forming method, comprising:

a dot formation conditions determining step of determining a dot size of dots and a pitch between adjacent dots to be formed by ejected droplets, according to print data;

a first dot forming step of forming a first dot by depositing a first droplet of radiation-curable ink onto a recording medium by ejecting the first droplet from a liquid ejection head according to the print data;

a preliminarily curing step of curing a surface of the first droplet to a threshold cured film thickness by irradiating radiation onto the first droplet; and a second dot forming step of forming a second dot by depositing a second droplet of the radiation-curable ink onto the recording medium by ejecting the second droplet from the liquid ejection head, while setting an ejection interval between the first and second droplets according to the dot size and the dot pitch determined in the dot formation conditions determining step, and controlling an ejection timing of the second droplet, in such a manner that the second droplet is deposited to overlap with the first droplet, after a time period required for a surface of the first droplet to reach the threshold cured film thickness by means of the preliminary curing step has elapsed.

* * * * *